US012336600B2

(12) United States Patent
Keyes

(10) Patent No.: US 12,336,600 B2
(45) Date of Patent: Jun. 24, 2025

(54) SHOE MEASUREMENT BASED ON FOOT FEATURES

(71) Applicant: Larry Keyes, Oak Park, IL (US)

(72) Inventor: Larry Keyes, Oak Park, IL (US)

( * ) Notice: Subject to any disclaimer, the term of this patent is extended or adjusted under 35 U.S.C. 154(b) by 794 days.

(21) Appl. No.: 17/590,982

(22) Filed: Feb. 2, 2022

(65) Prior Publication Data

US 2023/0012582 A1 Jan. 19, 2023

Related U.S. Application Data

(63) Continuation-in-part of application No. 17/027,150, filed on Sep. 21, 2020, now Pat. No. 12,089,700.

(60) Provisional application No. 62/904,228, filed on Sep. 23, 2019.

(51) Int. Cl.
*A43D 1/02* (2006.01)

(52) U.S. Cl.
CPC ..... *A43D 1/027* (2013.01)

(58) Field of Classification Search
CPC ..... A43D 1/022; A43D 1/025; A43D 1/027; A61B 5/103; A61B 5/107; A61B 5/1071; A61B 5/1072; A61B 5/1074; A61B 5/1079; G01B 5/02; G01B 11/02
See application file for complete search history.

(56) References Cited

U.S. PATENT DOCUMENTS

| | | | | |
|---|---|---|---|---|
| 2,793,439 | A * | 5/1957 | Simpson | A43D 1/027 33/3 B |
| 3,332,151 | A * | 7/1967 | Gressley | A43D 1/027 33/3 A |
| 9,119,442 | B2 * | 9/2015 | Oberhofer | A43D 1/027 |
| 2007/0266581 | A1 * | 11/2007 | Long | A43D 1/06 33/555.4 |
| 2012/0316827 | A1 * | 12/2012 | Wilkinson | G01B 21/20 702/150 |

* cited by examiner

*Primary Examiner* — Devin B Henson
(74) *Attorney, Agent, or Firm* — Amundsen Davis LLC

(57) ABSTRACT

A device includes a first arm, a second arm, and a lateral arm. The first arm may include a first length, a first socket disposed at a distal end, and a length fit indicator disposed at a proximal end. The second arm may include a second length, a first indication ball disposed at a distal end, and a first insertion point able to couple with the first socket. In addition, the second arm may include a second socket. The lateral arm may comprise a third length, a second indication ball, and a second insertion point to couple with the second socket.

12 Claims, 7 Drawing Sheets

SHOE MEASUREMENT BASED ON FOOT FEATURES

PRIORITY CLAIM

This application is a Continuation-in-Part of U.S. patent application Ser. No. 17/027,150, which claims priority to U.S. Provisional Patent Application No. 62/904,228, filed Sep. 23, 2019, the contents of which are hereby incorporated by reference.

BACKGROUND OF THE INVENTION

Footwear is worn by nearly every person for a number of hours on nearly every day. As such, it is important that a person's footwear not only be comfortable but fit correctly. Incorrect fit can lead to foot problems which may require further correction and treatment later on.

DETAILED DESCRIPTION

Figure 1A:
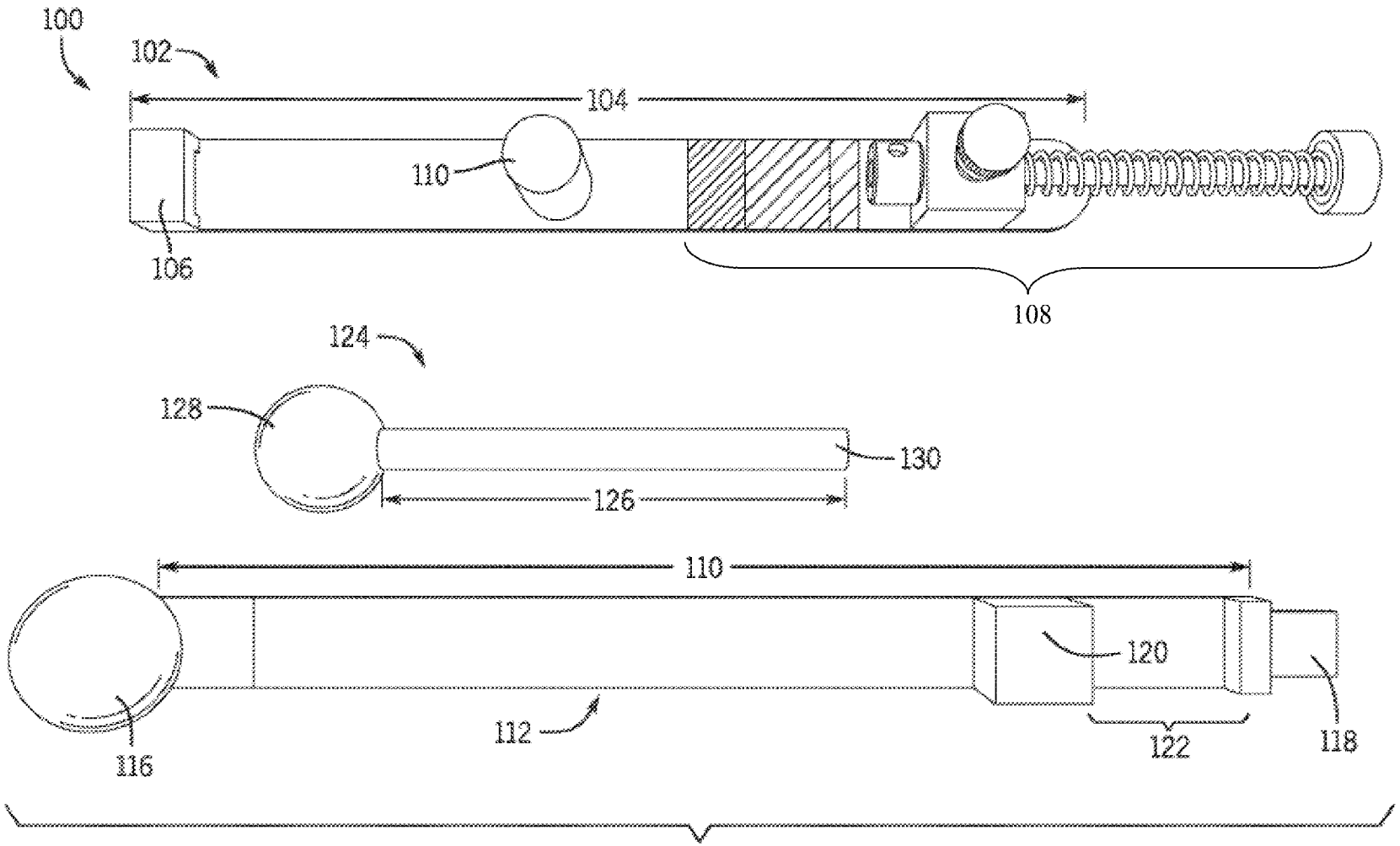
FIG. 1A is a view of the components of a device for shoe measurement based on foot features consistent with the present disclosure.

The importance of footwear fit cannot be overstated. Properly fitting footwear can not only assist in addressing existing foot problems, such as bunions and hammer toes, but can also help prevent future problems caused by forcing one's foot into ill-fitting shoes. When purchasing shoes, one often has their foot size measured; however, this provides an incomplete profile of the foot by primarily focusing on the length as measured from heel to big toe.

One way to attempt to provide a more complete foot profile is to perform a measurement of the foot that uses additional measurements beyond length. For example, a foot may have its width and depth measured, in addition to its length, in order to provide several measurement values for the same foot. Width and depth are, of course, important measurements to consider when determining what shoes to purchase, as some shoes are better for wider or narrower feet, or have additional depth. However, the measurement of length, width, and depth is often too crude; that is, measuring a foot with only those measurements may not accurately capture the unique features and issues with a person's fit. In many instances, a person may only have a significant issue with their foot, and thus with shoes, in a particular area of the foot, for example, the toes. While a length, width, and depth measurement may account for some of the issues with the foot, other issues may be unable to be accurately captured with those measurements, meaning that a person will be unable to use the information to help select the best fitting pair of shoes.

Another way to aid in shoe fit selection is to measure the shoe itself. Often, this is done by scanning the interior of a shoe and using the scan as the basis of a model for the shoe. However, as with the basic measurement of the foot, measurement of the shoe itself may not be sufficient to aid a person in selecting the best-fitting shoe for their foot. First, a consumer may not have sufficient knowledge to select the shoe that will work for their foot—or, conversely, eliminate a shoe from consideration-based on a scan of the interior of the shoe. Without an awareness of how the interior features of the shoe will interact with their particular foot and foot features, a person may simply not know how to translate a scan of a shoe's interior into a determination as to whether or not the shoe is a good match. In addition, because a person may only have an issue with a specific area of their foot, measuring the interior of a shoe may lead to false exclusions of a shoe that may otherwise work. For example, a person may know that they have an issue with their toe area and thus exclude shoes that, based on their internal scans, appear to have a narrow toe box. However, depending on the structure of the shoe in relation to the person's foot, the shoe with the narrow-appearing toe box may actually be a good fit for the person. With no way to test the shoe (apart from trying it on, which provides a limited sample), a person may be unnecessarily excluding shoes.

One way to combat the shortcomings of the individual approaches of foot measurement and shoe interior mapping is to combine the two approaches. One form this may take is inputting a person's foot length, width, and height measurements into a database, where the database also contains information corresponding to a variety of shoes that have had their interior features scanned. The measurements of the foot may then be digitally compared with, or "inserted" into, the shoe in order to help a person determine whether the shoe is likely to be a good fit. While this approach seems good at first glance, it does suffer from several problems. The first is that combining the foot measurement and shoe interior scan is cumbersome. If performed at a retail establishing, i.e., at the point of sale, a person would need to go through the steps of having their feet measured and then compared to a database of shoe interiors. This requires additional work on the part of the employees to perform a full set of measurements, as opposed to just a length measurement, which a retail employee may not be fully trained to do. Relatedly, performing these measurements at a retail location would necessitate additional equipment to perform the measurements, as opposed to a standard Brannock device currently used to measure length. The measurement concerns may be addressed by, for example, having the measurements performed at a doctor's office; however, doing the measurement at a separate location introduces additional steps, including printing out the measurements for the patient and having the patient bring the measurements with them every time they want to purchase a new pair of shoes. Moreover, in order to be truly comprehensive, every pair of available shoes would need to be scanned, even if it would be unlikely that one patient would buy the shoes, because another patient may choose to later. This would take a large amount of time to complete, because not only would all existing inventory need to be scanned, additional scans would need to be performed every time new inventory arrived.

By contrast, shoe measurement based on foot feature consistent with the present disclosure allows for precise analysis and checking of a shoe based on an individual user's foot features. A device may include a first arm, a second arm, and a lateral arm. The three arms may be stored as separate pieces and may be easily assembled when the user desires to check a shoe. A length fit indicator may be disposed at a proximal end of the first arm and may include components such as a spring, a rod, a ring, and a scale to indicate an appropriateness of the fit of the shoe for the user with respect to length. The device may further include a depth check indicator able to be selectively coupled to the device to determine whether the shoe has an appropriate depth for the user. Further, a width fit indicator may be included to measure the width of the shoe with respect to a particular feature of the user's foot.

FIG. 1A is a view of the components of a device 100 for shoe measurement based on foot features consistent with the present disclosure. Device 100 includes a first arm 102, a second arm 112, and a lateral arm 124. FIG. 1A shows the components of device 100 in a disassembled state; that is, FIG. 1A shows the components of device 100 disconnected from one another in order to show the individual components more clearly. The device 100 is shown assembled and discussed further herein with respect to FIG. 1B.

First arm 102 includes a first length 104. Disposed at a distal end of first length 104 is a socket 106. Socket 106 may be configured to receive another component of the device 100, and more particularly, socket 106 may serve as a coupling location for second arm 112. Although socket 106 is shown as substantially square in shape, examples are not so limited and any shape of socket 106 may be used, provided that the coupling portion of the second arm 112 is a complimentary shape.

Figure 1B:
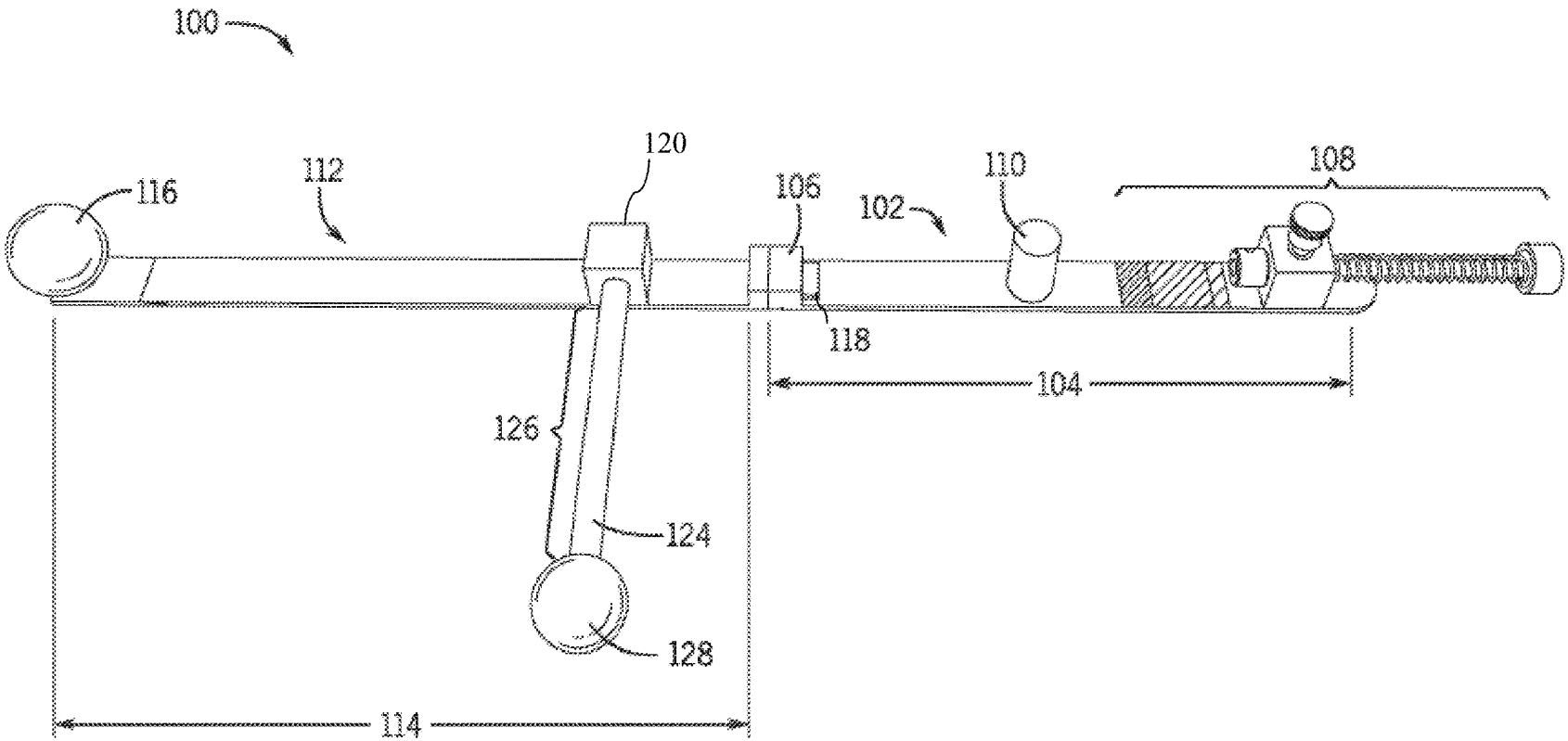
FIG. 1B is a view of a device for shoe measurement based on foot features with the components of FIG. 1A assembled consistent with the present disclosure.

A length fit indicator 108 may be disposed at a proximal end of the first length 104, such that the length fit indicator 108 is disposed opposite the socket 106. As shown in FIG. 1B, the length fit indicator 108 includes a variety of components. These components are discussed further herein with respect to one example of a length fir indicator 208, which can be used as a length fit indicator 108, in FIGS. 2A and 2B.

A manipulation post 110 is disposed at a midpoint along the first length 104. As used herein, a manipulation post refers to a protrusion extending perpendicularly from the first arm 102 to allow a user a location for easy grasping and movement of the first arm 102. Although the manipulation post 110 shown in FIG. 1A is cylindrical in shape, examples are not so limited and any shape manipulation post 110 may be used. In addition, the manipulation post 110 may be disposed at any point along first length 104 between the first socket 106 and length fit indicator 108.

Device 100 further includes a second arm 112. Second arm 112 has a second length 114. A first indication ball 116 may be disposed at a distal end of the second length 114. As used herein, an indication ball refers to a spherical indicator designed and sized to correspond to a particular feature of a foot. As such, first indication ball 116 may be sized differently based on the particular anatomy and features of a foot of a user of device 100. For example, first indication ball 116 may have a smaller diameter for a smaller foot, while a larger diameter may correspond to a larger foot. Examples are not so limited, however, and the size of the first indication ball 116 may be determined based on any appropriate feature or determination.

A first insertion point 118 may be disposed at a proximal end of the second length 114, opposite the first indication ball 116. First insertion point 118 may be sized and shaped such that it may couple with the first socket 106 on the first am 102. As such, when first insertion point 118 is inserted into first socket 106, first arm 102 and second arm 112 are coupled together. This setup is discussed further with respect to FIG. 18.

A second socket 120 may be disposed along the second length 114 of the second arm 112. As with first socket 106, second socket 120 may serve to receive an insertion point and serve as a coupling location for a portion of device 100, such as lateral arm 124. Second socket 120 may be disposed at a location a distance 122 away from the first insertion point 118, where distance 122 is shorter than second length 114.

A lateral arm 124 is further included in device 100. Lateral arm 124 has a third length 126, which may be shorter than first length 104 and/or second length 114. A second indication ball 128 may be disposed at a distal end of the third length 126. As with first indication ball 116, second indication ball 128 may be sized to correspond to a particular feature of a foot. More particularly, second indication ball 128 may be sized to correspond to a fifth metatarsal head.

A second insertion point 130 may be disposed at a proximal end of the third length 126, opposite second indication ball 128. The second insertion point 130 may couple to the second socket 120 of the second arm 112. When the second insertion point 130 is coupled to the second socket 120, the lateral arm 124 may be disposed perpendicularly with respect to the first arm 102 and the second arm 112. This arrangement is shown and discussed further herein with respect to FIG. 1B.

FIG. 1B is a view of a device 100 for shoe measurement based on foot features with the components of FIG. 1A assembled consistent with the present disclosure. As can be seen in FIG. 1B, second arm 112 has been coupled to first arm 102 by inserting first insertion point 118 into first socket 106. First indication ball 116 is disposed at the distal end of the second length 114, opposite the length fit indicator 104.

The lateral arm 124 has been coupled to second arm 112 at second socket 120, and as shown in FIG. 1B, extends perpendicularly from the second arm 112. As shown in FIG. 1B, the second indication ball 128 is disposed at the distal end of the lateral arm 124 and is separated from the second arm 112 by a third distance 126. As assembled as shown in FIG. 1B, device 100 is now ready for insertion into a shoe for measurement thereof.

Figure 2A:
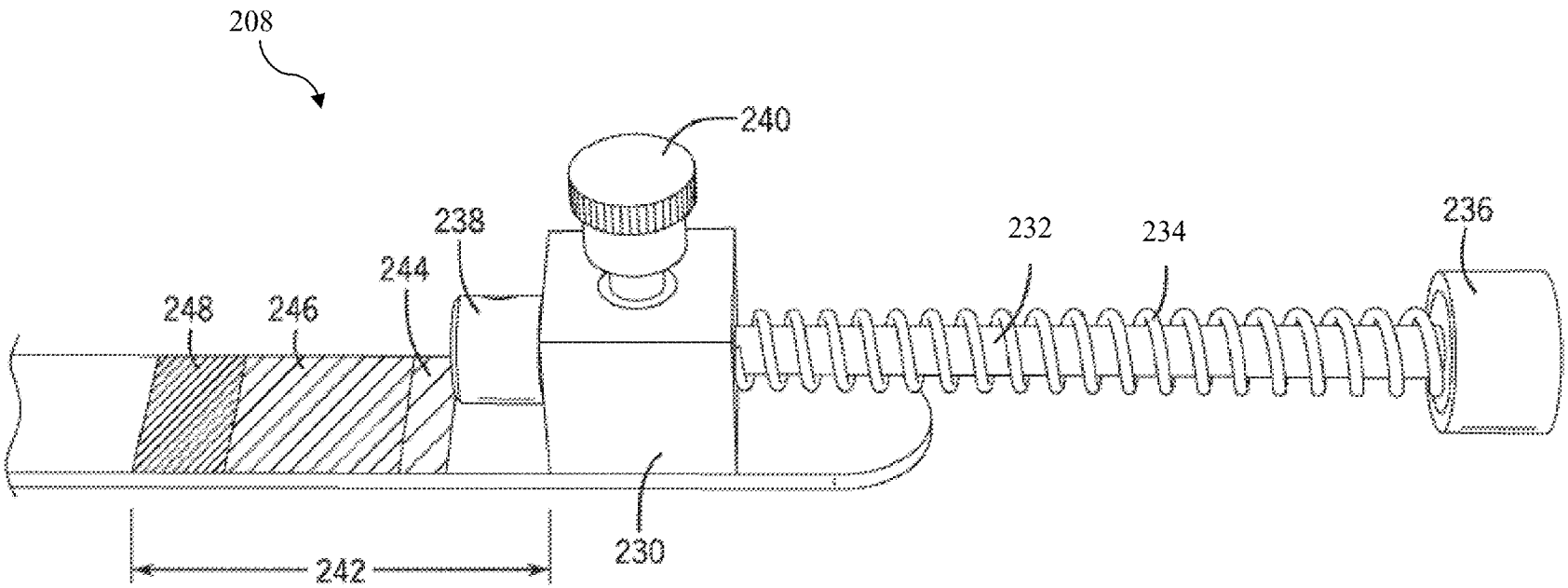
FIG. 2A is a view of the length fit indicator of the device for shoe measurement consistent with the present disclosure.

FIG. 2A is a view of the length fit indicator 208 of the device for shoe measurement consistent with the present disclosure. A housing 230 is coupled to the first arm. As used herein, a housing refers to a rigid casing that encloses or partially encloses another component of a device. Housing 230 may be made of plastic, metal, or any other suitable material. The housing 230 may have an opening disposed therethrough (not shown in FIG. 2A). A rod 232 may be coupled to the housing 230 through the opening, such that rod 232 extends through the housing 230 and is movable with respect to the housing 230.

A spring 234 is coupled to the rod 232 such that rod 232 passes through the center of the spring. As used herein, a spring refers to a helical coil that can be stretched or compressed but returns to its former shape when released. At a proximal end of the rod 232 may be a ring 236. The ring 236 may be coupled to rod 232 by a set screw collar or by any other suitable means to allow ring 236 to be secured to rod 232. Ring 236 may be sized to firmly contact a portion of a shoe while not being so large as to contact multiple portions of the shoe. That is, ring 236 may be sized to contact a portion of a shoe, such as a heel cup, but not be so large that ring 236 contacts the entire heel of a shoe, and thus will not contact a variety of contoured areas. Ring 236 may be made of metal, plastic, or any other suitable material.

At the distal end of the rod 232 is a clamp 238. As used herein, a clamp refers to a brace, band, or clasp used for holding two items in connection with one another. In the present device, clamp 238 may be used to fasten rod 232 such that rod 232 does not move with respect to housing 230. Clamp 238 is shown to be circular in FIG. 2A but examples are not so limited, and any suitably shaped clamp may be utilized. Additionally, a thumbscrew 240 may be coupled to a top portion of the housing 230. Thumbscrew 240 may be selectively screwable into an opening also disposed on the top portion of the housing 230 and have a portion that extends inwardly to the housing such that the inwardly extending portion contacts the rod 232. In such examples, the thumbscrew 240 may be used to "lock" the rod 232 into a particular position along a movement path.

A length fit scale 242 is disposed opposite the housing 230 and on the first arm of the device. The length fit scale 242 may further comprise a multiple-colored gauge, where each color represents or corresponds to a particular fit. For example, the multiple-colored gauge may have a red portion 248, a green portion 246, and a yellow portion 244. The red portion 248 may correspond to an indication that the shoe being measured by the device is too short, while the yellow portion 244 may correspond to an indication that the shoe being measured by the device is too long. The green portion 246 may correspond to an indication that the shoe being measured by the device is an appropriate and proper length for the user of the device.

Figure 2B:
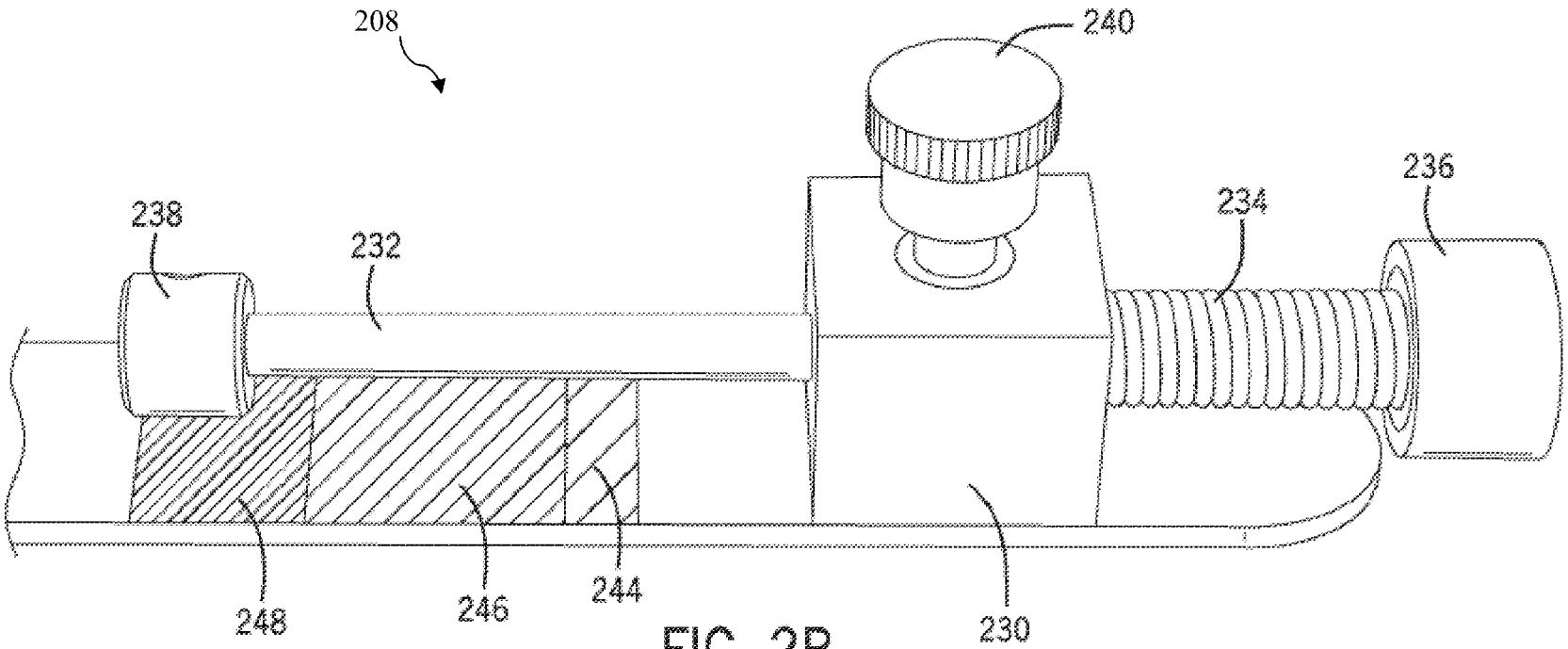
FIG. 2B is another view of the length fit indicator of FIG. 2A consistent with the present disclosure.

FIG. 2B is another view of the length fit indicator 208 of FIG. 2A consistent with the present disclosure. More particularly, FIG. 2B shows the length fit indicator 208 with the spring 234 compressed. This configuration may be used when the device, including the length fit indicator 208, is preparing for insertion into a shoe. Then, once the device is inserted into the shoe, the length fit indicator 208 may be selectively activated to measure the length of the shoe. This selective activation may occur, for example, by loosening the thumbscrew 240, allowing spring 234 to decompress up to the point that ring 236 contacts the shoe. In decompressing the spring 234, rod 232 may move through the opening in housing 230, extending ring 236.

Once ring 236 has contacted the shoe being measured, thumbscrew 240 may be re-tightened to "lock" rod 232 into place for analysis. More specifically, rod 232 may be locked into place so that a user can see which color of the multiple-colored gauge the rod 232 and/or the clamp 238 is over and thus, what the fit of the shoe is.

Figure 3:
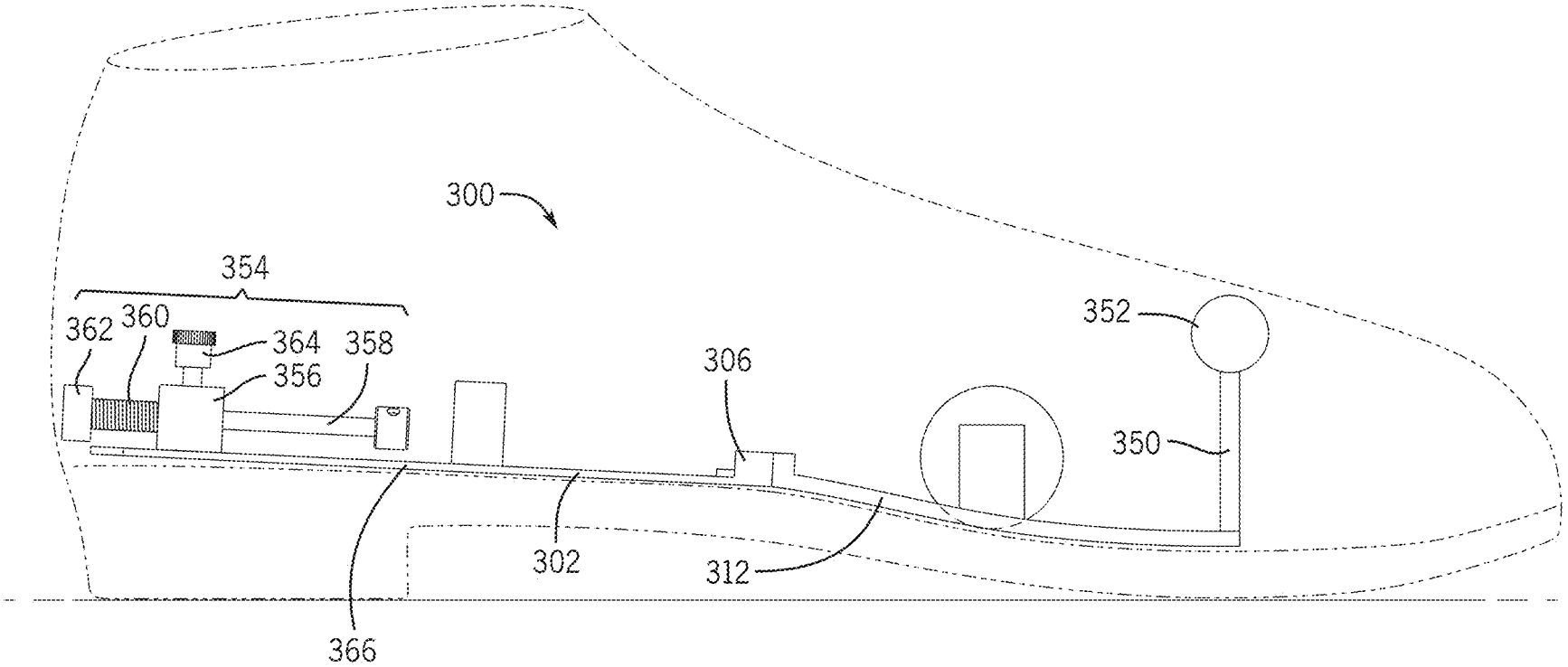
FIG. 3 is another view of a device for shoe measurement based on foot features consistent with the present disclosure.

FIG. 3 is another view of a device 300 for shoe measurement based on foot features consistent with the present disclosure. Device 300 includes a first arm 302, which is akin to first arm 102 discussed with respect to FIGS. 1A and 1B. Device 300 may also include a second arm 312, which may be coupled to the first arm 302 at socket 306 which is akin to 106. Device 300 further includes a depth check indicator. The depth check indicator may include a bar 350 that is able to be selectively coupled to the second arm 312. As shown in FIG. 3, bar 350 may be coupled to second arm 312 such that bar 350 extends perpendicularly from second arm 312. A pressure indication ball 352 may be disposed at the end of bar 350.

A depth fit indicator 354 may be coupled to the first arm 302 and, as shown in FIG. 3, may be coupled to the first arm 302 at a location opposite the bar 350 and pressure indication ball 352. Depth fit indicator 354 may further comprise a housing 356 coupled to the first arm 302. Housing 356 may be similar to housing 230, discussed with respect to FIGS. 2A and 2B. Housing 356 may have an opening disposed therethrough, through which a rod 358 may pass. Rod 358 may be movable with respect to the opening, and thus with respect to housing 356.

A pressure-rated compression spring 360 may be coupled to the rod 358 such that at least a portion of rod 358 passes through the spring 360. As used herein, a pressure-rated compression spring refers to a particular type of spring that has a known rate of compression and spring rate. When used as part of a depth fit indicator 354, spring 360 may be selected to correspond to a particular user's foot features and depth measurement needs.

A ring 362 may be coupled to a distal end of rod 358. As shown in FIG. 3, ring 362 may be disposed such that ring 362 is able to contact the back heel wall of the shoe. Ring 362 may be similar to ring 236, discussed with respect to FIGS. 2A and 2B. In some examples, ring 362 may be coupled to rod 358 using a set screw collar, although examples are not so limited.

A thumbscrew 364 may be disposed atop the housing 356. Thumbscrew 364 may be similar to thumbscrew 240, discussed with respect to FIGS. 2A and 2B. As with thumbscrew 240, thumbscrew 364 may be selectively engaged through a coupling within the housing 356, such that a portion of thumbscrew 364 may be introduced to an interior portion of housing 356 and, more particularly, may contact rod 358. In such examples, thumbscrew 364 may contact rod 358 in such a way as to prevent movement of rod 358 with respect to the opening disposed through housing 356 through which rod 358 passes.

A depth scale 366 (shown as a callout from FIG. 3) may be included as part of depth fit indicator 354. Similar to length fit scale 242 (discussed with respect to FIGS. 2A and 2B), depth scale 366 may indicate using colors, patterns, or another method of indication, the fit with respect to depth of the shoe. For example, the depth scale 366 may be divided into two portions, with one portion corresponding to sufficient depth and one portion corresponding to insufficient depth. However, examples are not so limited, and other numbers of portions may be used. In some examples, depth fit indicator 354 may be selectively activated upon insertion of device 300 into a shoe, particularly in a situation when the user is seeking to determine whether the shoe has appropriate depth for their particular foot features.

Figure 4:
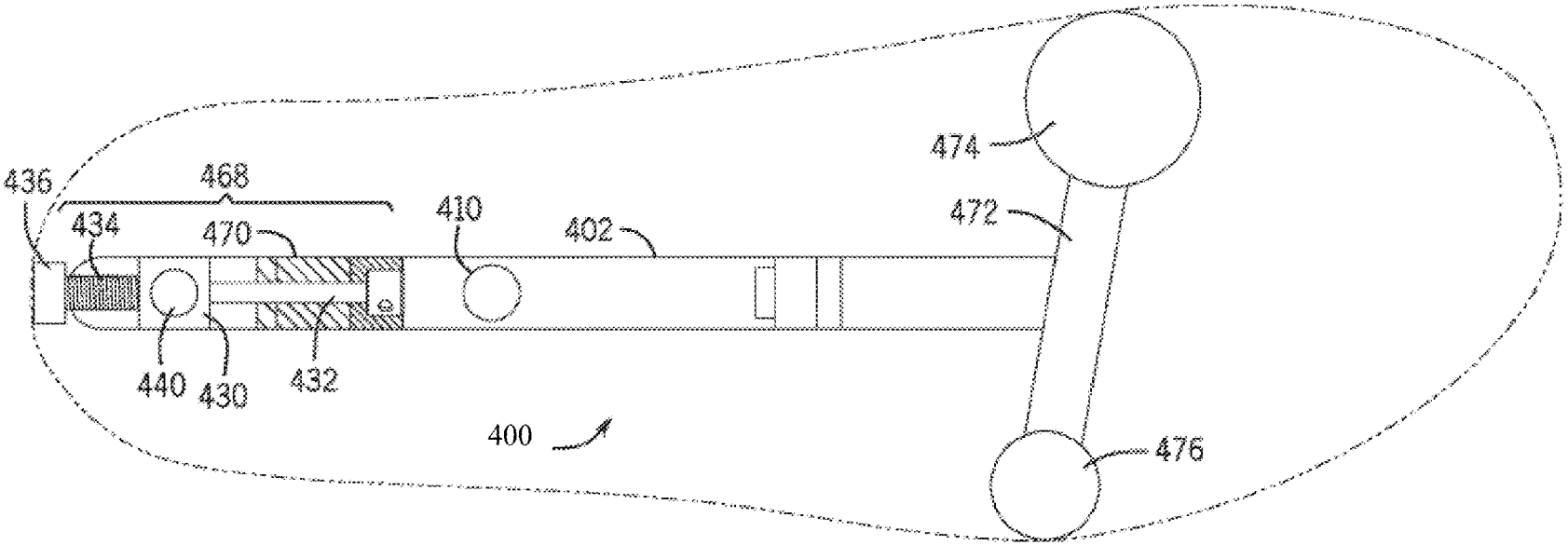
FIG. 4 is another view of a device for shoe measurement based on foot features consistent with the present disclosure.

FIG. 4 is another view of a device 400 for shoe measurement based on foot features consistent with the present disclosure. More particularly, FIG. 4 shows device 400 set up to measure a width of a shoe based on foot features. Device 400 includes a first arm 402. First arm 402 may further include a manipulation post 410. Manipulation post 410 may be akin to manipulation post 110, discussed with respect to FIG. 1, and may be used to help a user maneuver the device 400, particularly during the process of inserting into and extracting from a shoe. First arm 402 may further include a width fit indicator 468.

Width fit indicator 468 may include a housing 430 coupled to the first arm 402. Housing 430 may have an opening disposed therethrough (not shown in FIG. 4). A rod 432 may be coupled to the housing 430 through the opening, such that rod 432 is movable with respect to the housing 430.

A spring 434 may be coupled to the rod 432. More particularly, spring 434 may be coupled to rod 432 such that rod 432 passes through the center of the coils of spring 434. As shown in FIG. 4, spring 434 may be only coupled to rod 432 on one side of housing 430. A ring 436 may be coupled to a proximal end of rod 432. More particularly, ring 436 may be coupled to rod 432 using a set screw collar and as shown in FIG. 4, may be coupled to the rod 432 such that the spring 434 is on the same side of the rod 432 as the ring 436.

At a top portion of housing 430 may be a thumbscrew 440. Thumbscrew 440 may be coupled to housing 430 in such a way that thumbscrew 440 may be screwed into housing 430 and have a portion of thumbscrew 440 extend into housing 430. This portion of thumbscrew 440 that extends into housing 430 may contact rod 432. More particularly, thumbscrew 440 may "lock" the rod 432 into a particular position along a movement path and with respect to the movement of the rod 432 with respect to housing 430.

Width fit indicator 468 may further include a width fit scale 470. As used herein, a width fit scale refers to gauge or guide used to show the suitability of the width of the shoe being measured by device 400. Width scale 470 may include a multiple-colored gauge, where each color corresponds to a particular width suitability. For example, a first color may indicate that the width is too narrow for the particular foot features and a second color may indicate that the width is acceptable for the foot features.

Device 400 may further include a second arm 472 coupled to the first arm 402 at an end of the first arm 402. More specifically, second arm 472 may be coupled to first arm 402 at an end opposite width fit indicator 468. A first width feature indication ball 474 may be disposed at a first end of the second arm 472. First width feature indication ball 474 may correspond to an inner feature and position of a foot, and thus may be coupled to second arm 472 such that first width feature indication ball 474 contacts an inner sidewall of a shoe when device 400 is inserted into the shoe.

A second width feature indication ball 476 may be disposed at a second end of the second arm 472. Second width feature indication ball 476 may correspond to an outer feature and position of a foot and may be coupled to second arm 472 such that second width feature indication ball 474 contacts an outer sidewall of a shoe when device 400 is in use. Although second width feature indication ball 476 is shown in FIG. 4 to have a smaller diameter than first width feature indication ball 474, examples are not so limited; rather, the diameters of first width feature indication ball 474 and second width feature indication ball 476 will be customized and depend on the particular dimensions and features of the foot of the person for whom device 400 is made. As a result, the combination of the first width feature ball 474, the second width feature ball 476, and the second arm 472 may represent and correspond to a full width of the person's foot.

In use, device 400 may be inserted into a shoe and moved until the first width feature ball 474 and the second width feature ball 476 contact their respective sidewalls of the shoe. Width fit indicator 468 may then be selectively activated, allowing rod 432 to move and ring 436 to contact the back heel of the shoe. The position of rod 432 may be locked and the device 400 removed from the shoe. Once removed (or, indeed, while still in the shoe), a user can look at the width fit scale 470 and determine whether the shoe's width is appropriate for their particular needs and foot.

Figure 5:
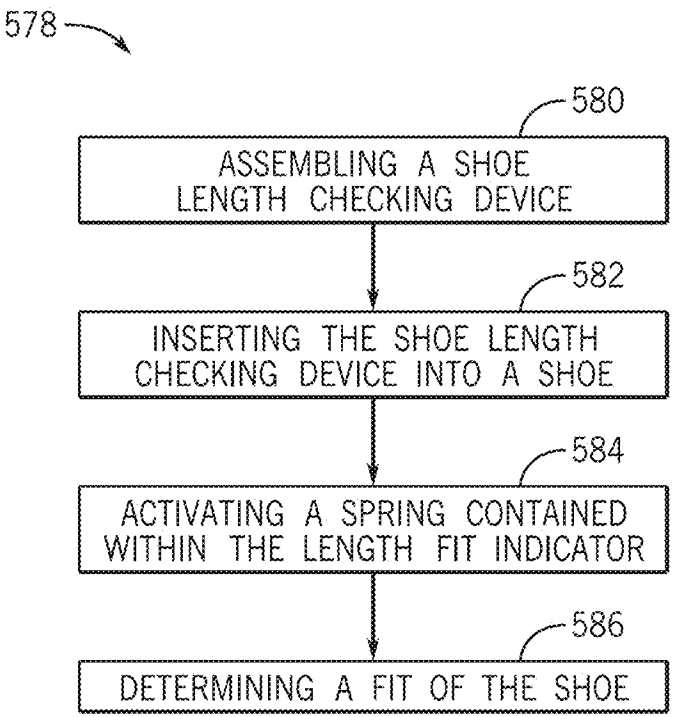
FIG. 5 is an example method for shoe measurement based on foot features consistent with the present disclosure.

FIG. 5 is an example method 578 for shoe measurement based on foot features consistent with the present disclosure. At 580, method 578 includes assembling a shoe length checking device. Shoe length checking device may be akin to device 100, 300, and/or 400, as shown in FIGS. 1A and 1B, FIG. 3, and FIG. 4, respectively. The shoe length checking device may include a first arm including a length fit indicator, a second arm including a first fit indication ball, and a third arm including a second fit indication ball. These components may be akin to the components outlined in FIGS. 1A and 1B and be assembled in a similar fashion as device 100 shown therein, although examples are not so limited.

At 582, method 578 includes inserting the shoe length checking device into a shoe. The shoe length checking device may be inserted into a shoe such that the first and second arm extend along a length of the shoe, as seen in FIG. 1B, for example. In addition, inserting the shoe length checking device into a shoe at 582 may include sliding the third arm of the shoe length checking device into the shoe such that the second fit indication ball contacts a sidewall of the shoe. Once the shoe length checking device is inserted into the shoe at 582, method 578 includes activating a spring contained within the length fit indicator at 584. As described particularly with respect to FIGS. 2A and 2B, the spring may be selectively activated when the device is inserted into the shoe and, when activated, may cause an end of the length fit indicator to contact a heel portion of the shoe.

At 586, method 578 includes determining a fit of the shoe based on a color of a scale contained on the first arm. As described with respect to FIGS. 2A and 2B, the first arm, and more particularly the length fit indicator, may include a multiple-colored gauge or scale, with each color corresponding to a particular fit, or non-fit, of the shoe. Once the spring has been activated at 584, the length fit indicator may move to be over one of the colors of the scale, and it is by checking this color that a user is able to determine whether the shoe being measured is an appropriate length or is too long or too short.

Method 578 may further include assembling a shoe depth checking device. As described particularly with respect to FIG. 3, the shoe depth checking device may include a pressure indication ball disposed at the end of a bar, the bar is then able to be selectively coupled to the first arm. The shoe depth checker may also include a depth fit indicator, which, as described with respect to FIG. 3, may include a pressure rated compression spring coupled to a rod. Once assembled, the shoe depth checking device may be inserted into a shoe. Method 578 may then include activating the pressure rated compression spring once the pressure indication ball has contacted the upper portion of the shoe. Once activated, the pressure rated compression spring may move, along with the rod, over a scale contained within the shoe depth checking device. As described with respect to FIG. 3, the scale may include multiple colors, with each color indicating an appropriateness of the depth of the shoe. As such, a user may then determine a fit of the shoe with respect to depth by reading the scale color.

Method 578 may further include assembling a shoe width checking device. As described particularly with respect to FIG. 4, the shoe width fit checking device may include a first width feature indication ball disposed at a first end of a second arm and a second width feature indication ball disposed at a second end of the second arm. The second arm may be selectively coupled to the first arm. The shoe width checking device may also include a width fit indicator which, as described with respect to FIG. 4, may include a pressure rated compression spring and a rod. Once assembled, the shoe width checking device may be inserted into a shoe. Method 578 may then include activating the pressure rated compression spring once the first width feature ball and the second width feature ball have contacted the sidewalls of the shoe. Once activated, the pressure rated compression spring may move, along with the rod, over a scale contained within the shoe width checking device. As described with respect to FIG. 4, the scale may include multiple colors, with each color indicating an appropriateness of the width of the shoe. As such, a user may then determine a fit of the shoe with respect to width by reading the scale color.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of an element and/or feature can refer to one or more of such elements and/or features.

What is claimed is:

1. A device for shoe measurement comprising:

a first arm having a first length, a first socket disposed at a distal end of the first length, and an indicator disposed at a proximal end of the first length; and a second arm coupled to the first arm using the socket;

wherein the indicator includes:

a housing coupled to the first arm, wherein the housing includes an opening disposed therethrough;

a rod that extends through the opening, wherein the rod is movable with respect to the opening;

a ring coupled to a proximal end of the rod;

a compression spring on the same side of the housing as the ring, wherein the rod passes through the center of the compression spring; and a scale disposed on the first arm of the device to indicate a fit of a shoe.

2. The device of claim 1, further comprising:

a thumbscrew coupled to a top portion of the housing, wherein the thumbscrew locks the rod in a particular position along a movement path.

3. The device of claim 1, wherein the second arm further comprises:

a second length;

a first indication ball disposed at a distal end of the second length;

a first insertion point disposed at a proximal end of the second length for coupling the second arm and the first arm.

4. The device of claim 1, further comprising a lateral arm disposed perpendicularly with respect to the first arm and the second arm that includes:

a third length;

a second indication ball disposed at one end of the third length; and a second insertion point disposed at an opposite end of the third length for coupling the lateral arm to the second arm.

5. The device of claim 1, further comprising a bar that extends perpendicularly from the second arm, and a pressure indication ball disposed at an end of the bar.

6. The device of claim 1, wherein the scale includes a multiple-colored gauge, wherein each color of the multiple-colored gauge corresponds to a particular shoe fit.

7. The device of claim 6, wherein the multiple-colored gauge includes:

a red portion, wherein the red portion corresponds to an indication that a shoe being measured by the device is too short;

a green portion, wherein the green portion corresponds to an indication that the shoe being measured by the device is a proper length; and a yellow portion, wherein the yellow portion corresponds to an indication that the shoe being measured by the device is too long.

8. The device of claim 1, wherein the second arm includes:

a first portion coupled to the first arm;

a second portion having a first end and a second end;

a first width feature ball disposed at the first end of the second portion to correspond to an inner feature and position of a foot; and a second width feature ball disposed at the second end of the second portion to correspond to an outer feature and position of the foot.

9. The device of claim 1, further comprising a manipulation post disposed at a midpoint along the first length.

10. A method of measuring fit of a shoe, the method comprising:

assembling a device for shoe measurement, wherein the device for shoe measurement incudes:

a first arm having a first length, a first socket disposed at a distal end of the first length, and an indicator disposed at a proximal end of the first length; and a second arm coupled to the first arm using the socket;

wherein the indicator includes:

a housing coupled to the first arm, wherein the housing includes an opening disposed therethrough;

a rod that extends through the opening, wherein the rod is movable with respect to the opening;

a ring coupled to a proximal end of the rod;

a compression spring on the same side of the housing as the ring, wherein the rod passes through the center of the compression spring; and a scale disposed on the first arm of the device to indicate a fit of a shoe, inserting the device into a shoe;

activating the compression spring of the indicator such that the ring of the indicator contacts a heel of the shoe; and determining a fit of the shoe based on the scale.

11. The method of claim 10, wherein:

assembling the device for shoe measurement includes coupling a lateral arm to the second arm such that the lateral arm is disposed perpendicularly with respect to the first arm and the second arm, the lateral arm including a third length, a second indication ball disposed at one end of the third length, and a second insertion point disposed at an opposite end of the third length for coupling the third arm to the second arm; and inserting the device into the shoe includes sliding the lateral arm of the device into the shoe such that the second indication ball contacts a sidewall of the shoe.

12. The method of claim 10, wherein the second arm includes a first portion coupled to the first arm, a second portion having a first end and a second end, a first width feature ball disposed at the first end of the second portion to correspond to an inner feature and position of a foot, and a second width feature ball disposed at the second end of the second portion to correspond to an outer feature and position of the foot; and wherein inserting the device into the shoe includes sliding the device along the shoe until the first width feature ball contacts an inner sidewall of the shoe and the second width feature ball contacts an outer sidewall of the shoe.

* * * * *